US006769876B2

(12) United States Patent
Sakai et al.

(10) Patent No.: US 6,769,876 B2
(45) Date of Patent: Aug. 3, 2004

(54) CENTRIFUGAL VENTILATOR FAN

(75) Inventors: Masaharu Sakai, Kariya (JP); Kouji Matsunaga, Kariya (JP); Yasushi Mitsuishi, Nishio (JP); Yoshiki Tada, Nishio (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 141 days.

(21) Appl. No.: 10/245,142

(22) Filed: Sep. 16, 2002

(65) Prior Publication Data

US 2003/0053911 A1 Mar. 20, 2003

(30) Foreign Application Priority Data

Sep. 17, 2001 (JP) ..... 2001-281930

(51) Int. Cl.[7] ..... F04D 29/30

(52) U.S. Cl. ..... 416/187; 416/223 B; 416/DIG. 2; 415/206

(58) Field of Search ..... 416/185, 186 R, 416/187, 188, 223 B, DIG. 2; 415/206, 204

(56) References Cited

U.S. PATENT DOCUMENTS 4,647,271 A * 3/1987 Nagai et al. ..... 416/186 R

FOREIGN PATENT DOCUMENTS

| | | |
|---|---|---|
| JP | 6-307390 | 11/1994 |
| JP | 11-82382 | 3/1999 |

* cited by examiner

*Primary Examiner*—Edward K. Look
*Assistant Examiner*—Kimya N McCoy
(74) *Attorney, Agent, or Firm*—Harness, Dickey & Pierce, PLC

(57) ABSTRACT

A centrifugal ventilator fan, which has improved fan performance and lower noise. A first outlet angle, on an upstream end of the fan, is less than a second outlet angle. Additionally, the first outlet angle is equal to zero degrees or greater and five degrees or less, while the second outlet angle is equal to thirty degrees or greater and forty five degrees or less. Furthermore, a first inlet angle, on an upstream end, is greater than a second inlet angle, on the opposite end. The first inlet angle is equal to sixty-five degrees or greater and ninety degrees or less, and the second inlet angle is equal to fifty-five degrees or more and seventy-five degrees or less.

12 Claims, 16 Drawing Sheets

CENTRIFUGAL VENTILATOR FAN

CROSS REFERENCE TO RELATED APPLICATION

This application relates to and incorporates by reference Japanese patent application number 2001-281930, which was filed on Sep. 17, 2001.

BACKGROUND OF THE INVENTION

The present invention relates to a centrifugal ventilator fan (see JIS B 0132 No.1004) which has blades radially spaced about the axis of rotation and which operates such that air enters axially through an inlet and is discharged radially.

In a centrifugal ventilator fan disclosed in Japanese unexamined patent publication No. Hei 6-307390, the blades are smoothly twisted with respect to a plane passing through the center of the hub to improve performance. However, it is not always possible to provide improved fan performance and reduced noise levels merely by twisting the blades.

SUMMARY OF THE INVENTION

The present invention was developed in view of the aforementioned points. It is therefore an object of the invention to positively provide improved fan performance and reduced noise levels.

To achieve the aforementioned object, according to a first aspect of the present invention there is provided a centrifugal ventilator fan which has multiple blades spaced about an axis of rotation and which operates with air entering axially through an inlet at an end thereof and being discharged radially outwardly. The centrifugal ventilator fan is designed such that a first fan outlet angle of the blades at one end in a direction of the axis of rotation is less than a second fan outlet angle of the blades at the other end in the direction of the axis of rotation. Additionally, the first fan outlet angle is equal to zero degrees or greater and five degrees or less, while the second fan outlet angle is equal to thirty degrees or greater and forty-five degrees or less.

As will be seen clearly from FIGS. 5 and 6 described later, this makes it possible to provide improved fan performance and reduced noise levels.

According to a second aspect of the present invention a centrifugal ventilator fan has multiple blades spaced about an axis of rotation and which operates with air entering axially through an inlet at an end thereof and being discharged radially outwardly. The centrifugal ventilator fan is designed such that a first fan inlet angle of the blades at one end in a direction of the axis of rotation is larger than a second fan inlet angle of the blades at the other end in the direction of the axis of rotation. Additionally, the first fan inlet angle is equal to sixty-five degrees or greater and ninety degrees or less, while the second fan inlet angle is equal to fifty-five degrees or greater and seventy-five degrees or less.

As will be seen clearly from FIGS. 7 and 8 described later, this makes it possible to provide improved fan performance and reduced noise levels.

According to a third aspect of the present invention, a centrifugal ventilator fan has multiple blades spaced about an axis of rotation and which operates with air entering axially through an inlet at an end thereof and being discharged radially outwardly. The centrifugal ventilator fan is designed such that a first fan outlet angle of the blades at one end in a direction of the axis of rotation is less than a second fan outlet angle of the blades at the other end in the direction of the axis of rotation. Additionally, the first fan outlet angle is equal to zero degrees or greater and 5 degrees or less, while the second fan outlet angle is equal to 30 degrees or greater and forty-five degrees or less. The centrifugal ventilator fan is further designed such that a first fan inlet angle of the blades at the one end in the direction of the axis of rotation is larger than a second fan inlet angle of the blades at the other end in the direction of the axis of rotation. Additionally, the first fan inlet angle is equal to sixty-five degrees or greater and ninety degrees or less, while the second fan inlet angle is equal to fifty-five degrees or greater and seventy-five degrees or less.

As will be seen clearly from FIGS. 5 to 8 described later, this makes it possible to provide improved fan performance and reduced noise levels.

According to a fourth aspect of the invention, a vane surface of the blade is generally parallel to the axis of rotation.

This allows a fan mold die to easily release the fan in the direction parallel to the axis of rotation, thereby making it possible to improve the productivity of the centrifugal ventilator fan.

According to a fifth aspect of the invention, a ratio of a fan outer diameter at the other end of the axis of rotation to a fan outer diameter at the one end of the axis of rotation is equal to 0.9 or greater and 1.0 or less.

As will be seen clearly from FIG. 9 described later, this makes it possible to provide improved fan performance and reduced noise levels.

According to a sixth aspect of the invention, a ratio of a fan inner diameter at the other end of the axis of rotation to a fan inner diameter at the one end of the axis of rotation is equal to 0.9 or greater and 1.0 or less.

As will be seen clearly from FIG. 9, which is described later, this makes it possible to provide improved fan performance and reduced noise levels.

Incidentally, the parenthesized numerals accompanying the foregoing individual means show an example of correspondence with concrete means seen in the embodiments to be described later.

DETAILED DESCRIPTION OF THE PREFERRED EMBODIMENTS

First Embodiment

Figure 1:
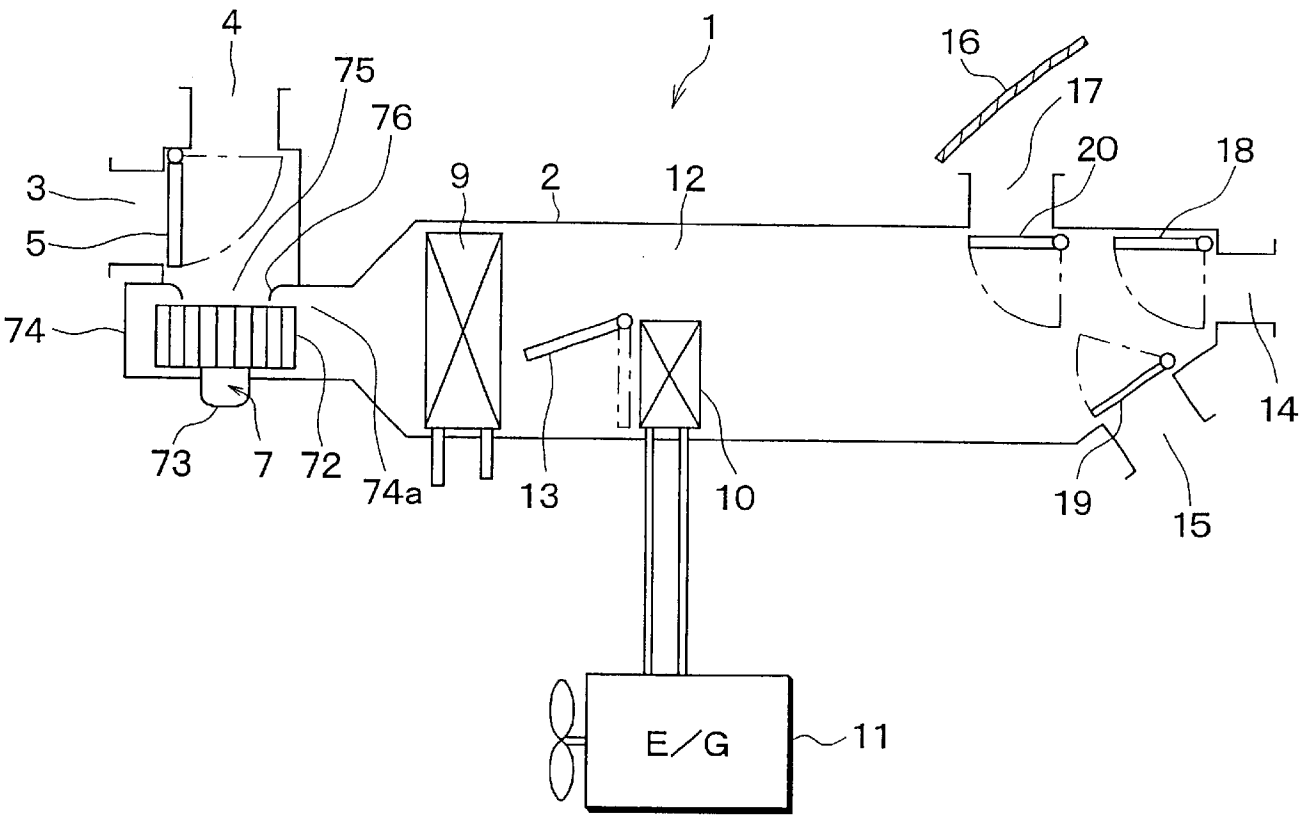
FIG. 1 is a diagrammatic view of an air conditioner in which the present invention is employed.

In the first embodiment, an air blower having a centrifugal multi-blade fan according to the present invention is applied to a vehicle-mounted air conditioner. FIG. 1 shows a vehicle-mounted air conditioner 1 for use in a vehicle with a water-cooled engine.

An upstream portion of an airflow path in an air conditioner case 2 is provided with an indoor air inlet 3, for drawing passenger compartment air, and an outdoor air inlet 4, for drawing outdoor air. An inlet switching door 5 selectively switches between the inlets 3, 4.

Downstream of the inlet switching door 5 is a filter (not shown) for filtering dust particles in the air and an air blower 7 according to the present invention. The air blower 7 blows air drawn through either the indoor inlet 3 or the outdoor inlet 4 toward outlets 14, 15, 17, which are described later.

Downstream of the air blower 7, is an evaporator 9, which serves as air cooling means, through which all the air blown by the air blower 7 passes. Additionally, downstream of the evaporator 9, there is a heater core 10, which serves as air heating means and which employs engine cooling fluid, for an engine 11, as a heat source to heat air. In FIG. 1, the air blower is illustrated schematically and will be detailed later.

In the air conditioner case 2, a bypass path 12 is formed for bypassing the heater core 10. Upstream of the heater core 10 is an air mixing door 13 for adjusting the ratio of the airflow through the heater core 10 to that through the bypass path 12 to control the temperature of the air entering the passenger compartment of the vehicle.

At the downstream portion of the airflow path in the air conditioner case 2, a face outlet 14, for directing conditioned air toward the upper part of a passenger's body in the passenger compartment, a foot outlet 15, for discharging air toward the lower part of the passenger's body in the passenger compartment, and a defrost outlet 17, for directing air to the inner surface of a windshield 16.

Upstream of the outlets 14, 15, 17, there are outlet mode switching doors 18, 19, 20, respectively. The outlet mode switching doors 18, 19, 20 are selectively opened and closed, to switch between a face mode for directing air toward the upper part of the passenger's body, a foot mode for directing air toward the lower part of the passenger's body, and a defrost mode for directing air to the inner surface of the windshield.

The air passage system of the air conditioner is illustrated schematically in FIG. 1. In practice, the air passage system is designed such that the loss in pressure of the air passage system in the foot and defrost modes is greater than that of the air passage system in the face mode.

Figure 3:
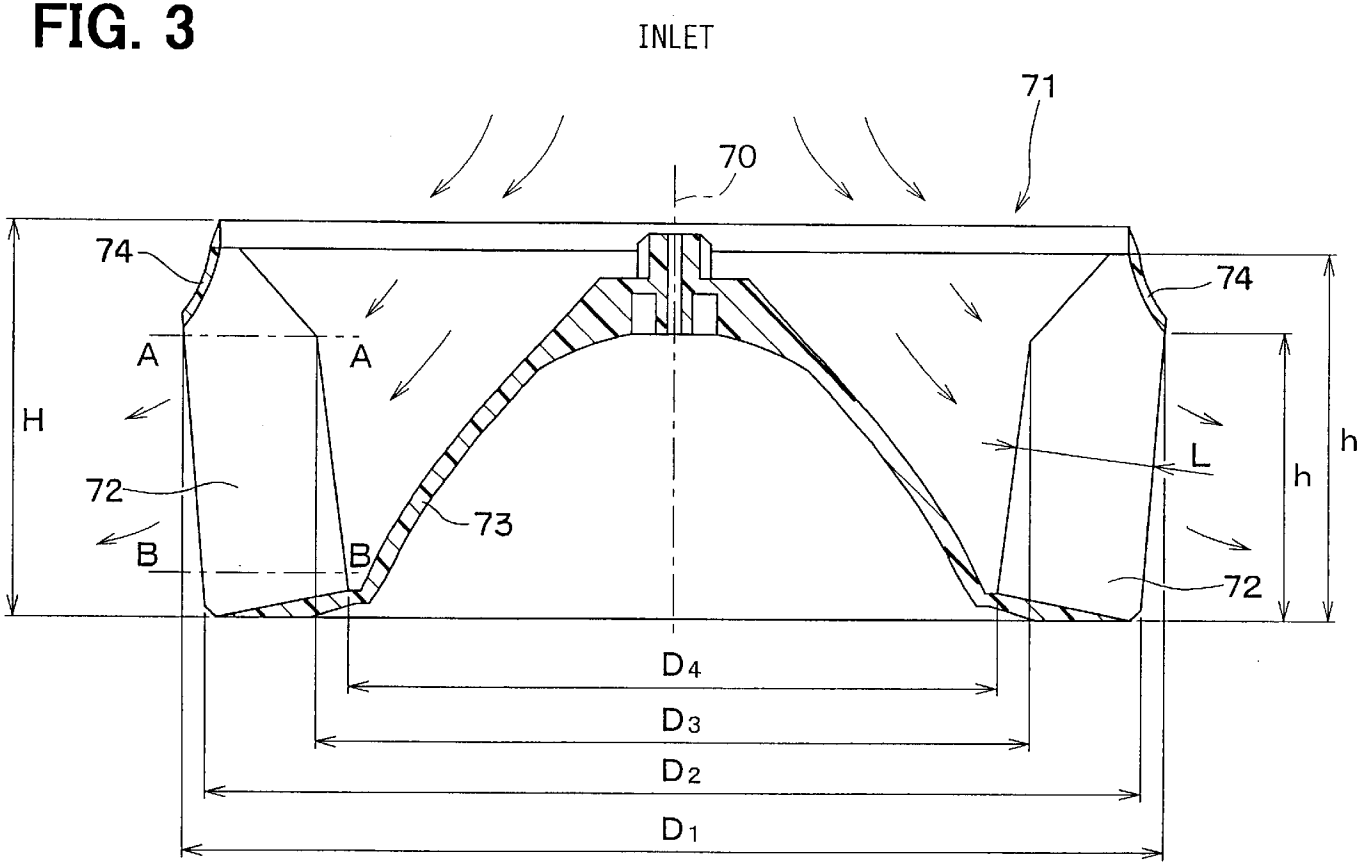
FIG. 3 is a cross-sectional view illustrating a ventilator fan rotor according to a first embodiment.

Referring to FIG. 3, a centrifugal ventilator fan 71, which includes blades (vanes) 72 radially spaced about the axis of rotation 70 and a retainer plate (boss) 73 for retaining the blades 72, is shown. The ventilator fan 71 operates such that air enters the ventilator fan 71 from an axial end (from above in the figure), and passes through the blades 72. The air is centrifugally discharged radially from the ventilator fan 71.

Additionally, on the inlet side of the ventilator fan 71, there is a shroud 74, which is integrally formed of plastic with the blades 72 and the retainer plate 73. The shroud 74 is shaped (generally arc-shaped in cross section) to guide the stream passing through the blades 72, such that the cross-sectional area of the airflow path is reduced from upstream to downstream, as shown in FIG. 3.

Figure 2:
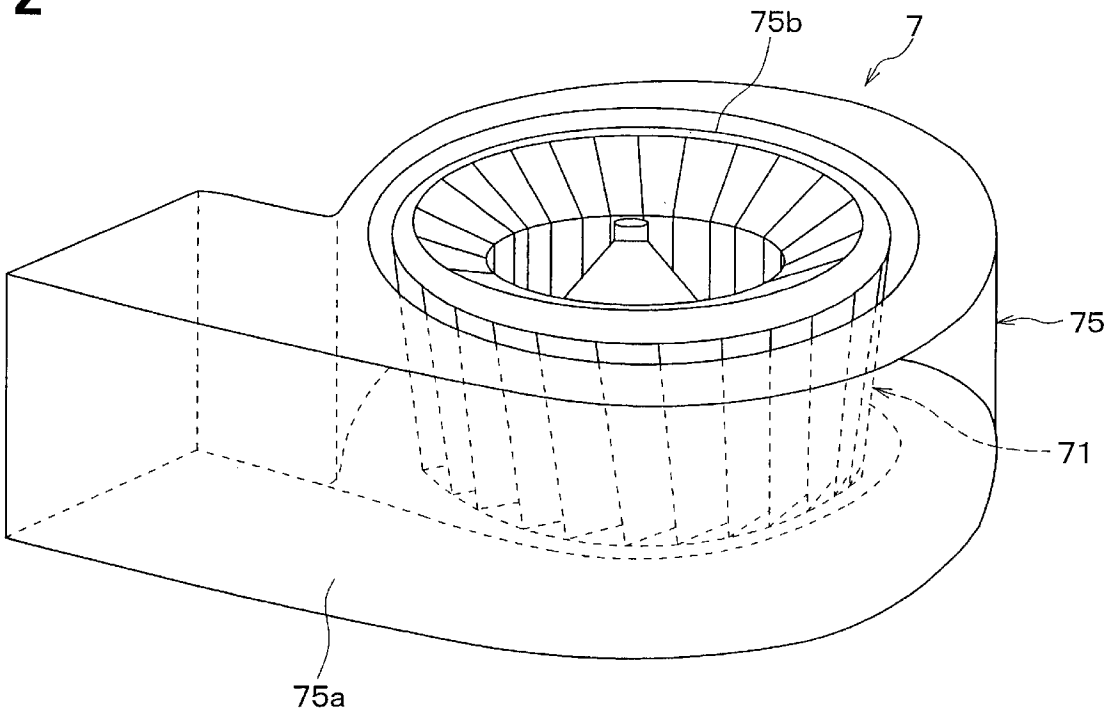
FIG. 2 is a perspective view illustrating a fan according to the present invention.

As shown in FIG. 2, the ventilator fan 71 is housed in a plastic scroll case 75, which forms a spiral flow path 75*a* through which the air discharged from the ventilator fan 71 is collected. At one end of the case 75, there is an inlet 75*b* for guiding air toward the inside of the ventilator fan 71. At the other end, is drive means (not shown), such as an electric motor, for driving the ventilator fan 71.

At the outer edge of the inlet 75*b*, a bell mouth (not shown) is integrated with the case 75 for directing air toward the inside of the ventilator fan 71. Near the inlet 75*b* in the case 75, there is an opposing wall (not shown) spaced by a certain distance from the shroud 74 along the curved surface of the shroud 74.

Figure 4B:
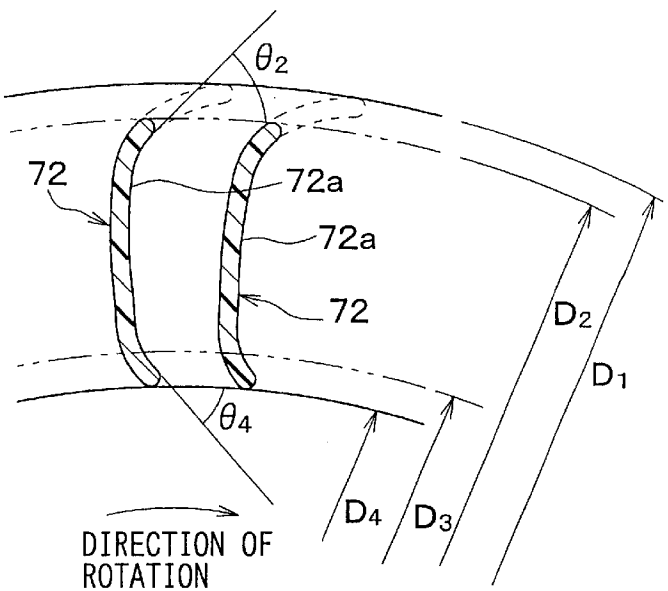
FIG. 4B is a cross-sectional view taken along line B—B of FIG. 3.
Figure 4A:
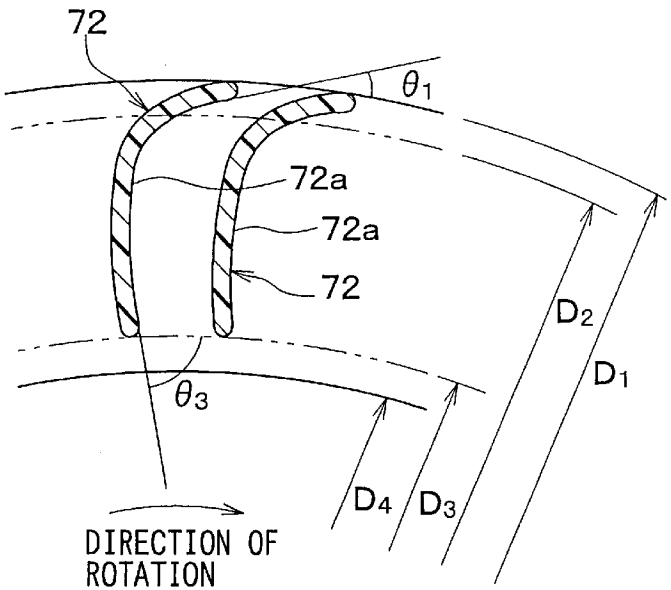
FIG. 4A is a cross-sectional view taken along line A—A of FIG. 3.
Figure 5:
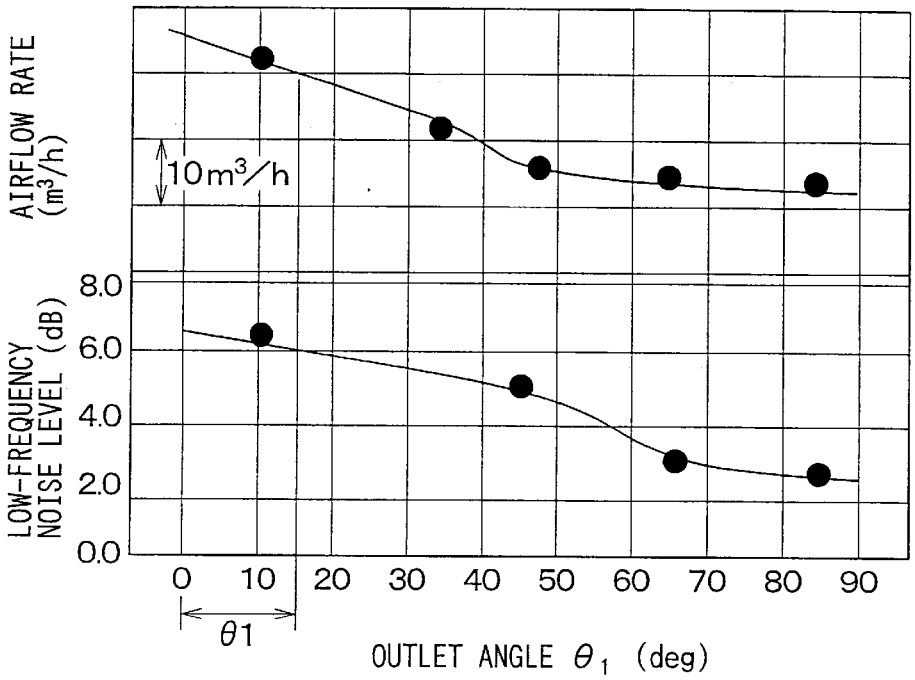
FIG. 5 is a graph showing the relationships between the first outlet angle and the noise level and the volumetric airflow.
Figure 6:
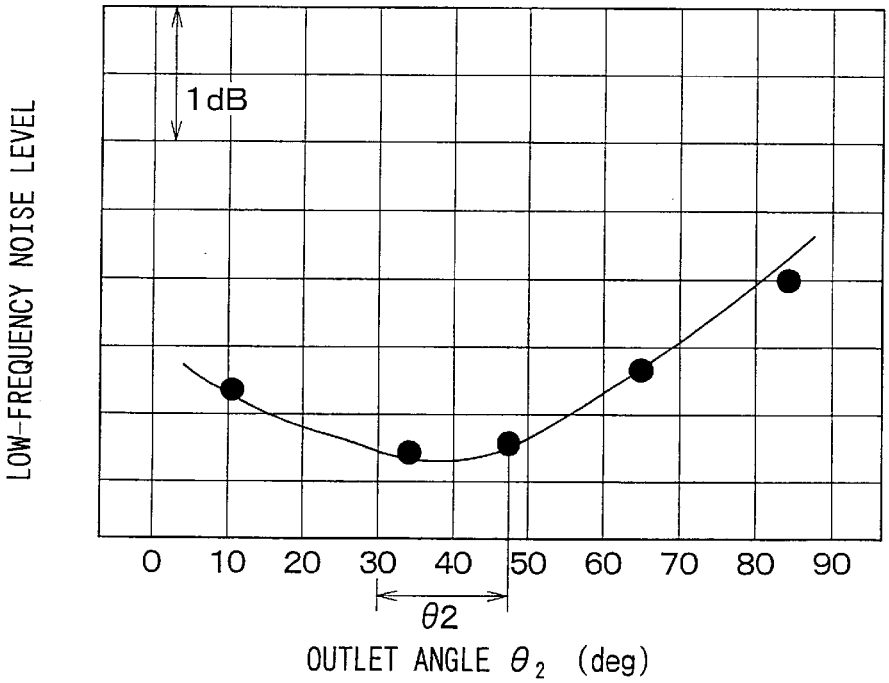
FIG. 6 is a graph showing the relationship between the second outlet angle and low frequency noise level.
Figure 7:
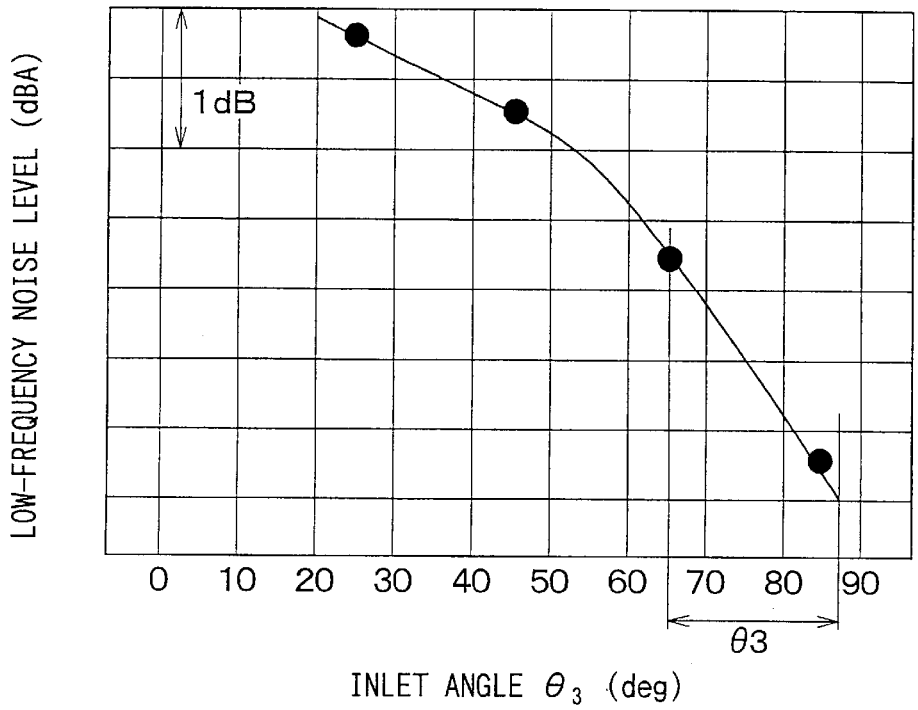
FIG. 7 is a graph showing the relationship between the first inlet angle and low frequency noise level.
Figure 8:
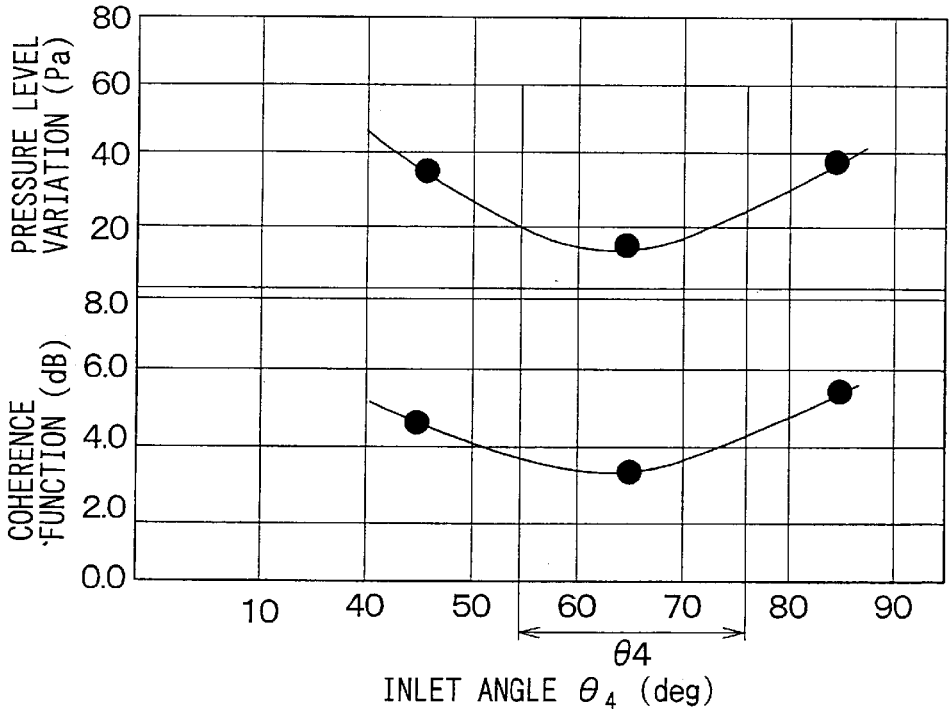
FIG. 8 is a graph showing relationships between the second inlet angle and pressure level and coherence function values.

As shown in FIGS. 3, 4A and 4B, the ventilator fan 71 according to this embodiment is designed such that the upstream fan outlet angle (hereinafter referred to as the first outlet angle) θ1 of the blades 72 is less than the downstream fan outlet angle (hereinafter referred to as the second outlet angle) θ2 of the blades 72. Additionally, the first outlet angle θ1 is zero degrees or greater and five degrees or less (2.5 degrees in the illustrated embodiment), and the second outlet angle θ2 is thirty degrees or greater and forty-five degrees or less (45 degrees in the illustrated embodiment).

On the other hand, the upstream fan inlet angle (hereinafter referred to as the first inlet angle) θ3 of the blades 72 is larger than the downstream fan inlet angle (hereinafter referred to as the second inlet angle) θ4 of the blades 72. Additionally, the first inlet angle θ3 is sixty-five degrees or greater and ninety degrees or less (85 degrees in the illustrated embodiment), and the second inlet angle θ4 is equal to fifty-five degrees or greater and seventy-five degrees or less (65 degrees in the illustrated embodiment).

As shown in FIGS. 4A and 4B, the fan inlet angle refers to the angle of intersection between a line extending from the blades 72 and a circle defined by the inner edges of the blades 72, and is measured in the direction of rotation of the ventilator fan 71 as shown. On the other hand, the fan outlet angle refers to the angle of intersection between a line extending from the blades 72 and a circle defined by the outer edges of the blades 72 and is measured in the direction of rotation of the ventilator fan 71 as shown.

As shown in FIGS. 4A and 4B, taking the easiness of die releasing into consideration upon forming the ventilator fan 71 of plastics, vane surfaces 72*a* of the blades 72 are each generally parallel to the axis of rotation 70.

Accordingly, as shown in FIG. 3, the outer diameter D1 and the inner diameter D3 of the ventilator fan 71 at the inlet end are greater than the outer diameter D2 and the inner diameter D4 of the ventilator fan 71 at the outlet end. More specifically, the ratio of the fan outer diameter D2 at the outlet end to the fan outer diameter D1 at the inlet end (D2/D1) is equal to 0.9 or greater and 1.0 or less (0.96 in this embodiment). On the other hand, the ratio of the fan inner diameter D4 at the outlet end to the fan inner diameter D3 at the inlet end (D4/D3) is equal to 0.9 or greater and 1.0 or less (0.95 in this embodiment).

In this embodiment, the fan outer diameter D1 is 165 mm, the fan outer diameter D2 is 160 mm, and a vane chord length L is 23 mm (refer to FIG. 3).

As described above, the outer diameter D1 and the inner diameter D3 of the ventilator fan 71 at the inlet end are different from the outer diameter D2 and the inner diameter D3 of the ventilator fan 71 at the opposite end. Accordingly, the blades 72 are inclined with respect to the axis of rotation 70. For this reason, the outlet angle and the inlet angle are gradually varied from inlet end to the outlet end.

The vane surfaces of the blade are subjected to drag and lift in the air, including the two surfaces that receive reduced pressure and increased pressure, respectively (e.g., see *Fluid Mechanics* (Tokyo University Press)).

Figure 9:
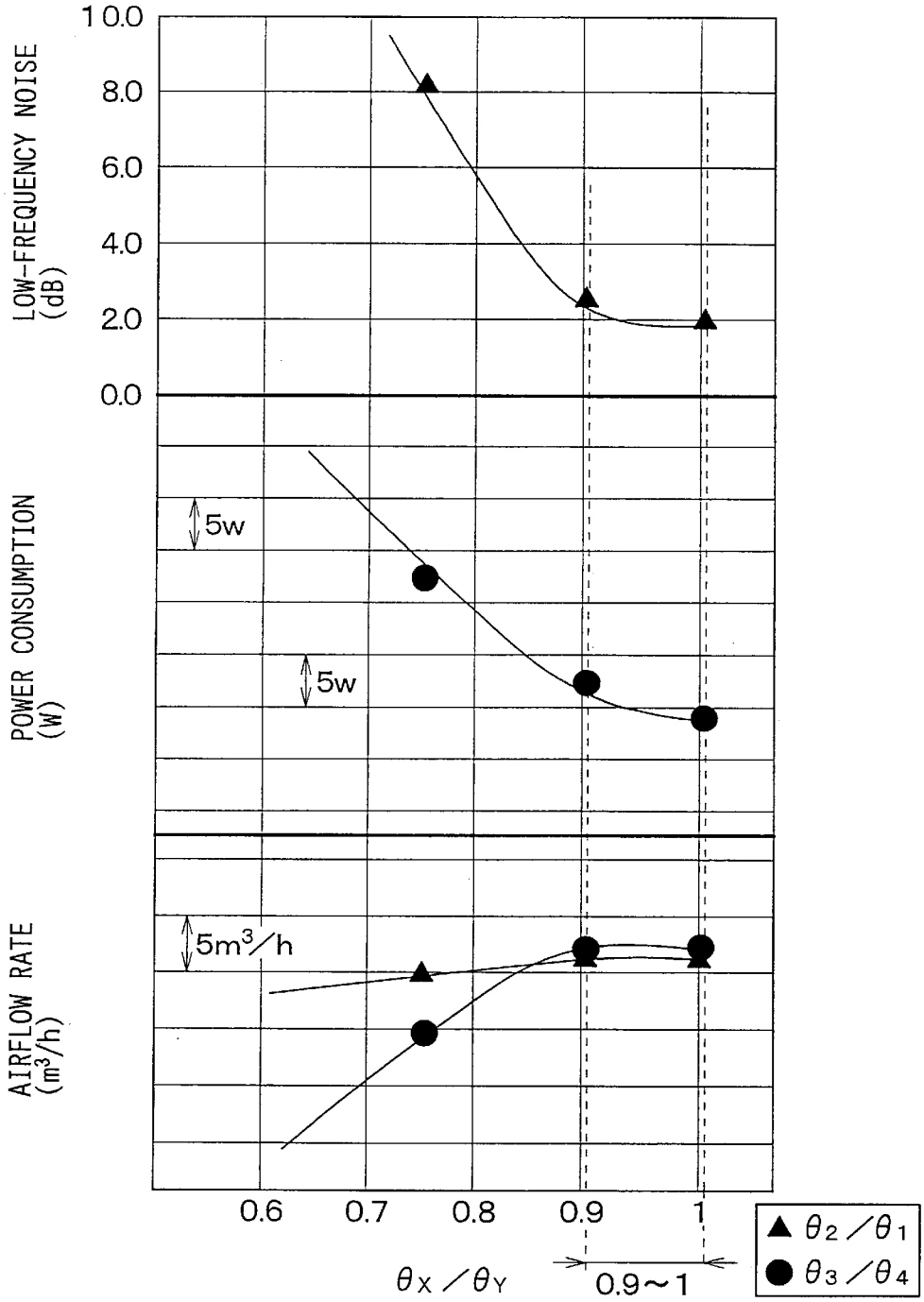
FIG. 9 is a graph showing relationships between diameter ratios of the ventilator fan with volumetric airflow, power consumption, and low-frequency noise level.

FIGS. 5 to 8 are graphs of the results of investigations of the outlet angles θ1, θ2 and inlet angles θ3, θ4. FIG. 9 is a graph showing the results of investigations of the ratio of the fan outer diameters D2 to D1 (D2/D1) and the ratio of the fan inner diameters D4 to D3 (D4/D3).

As can be seen clearly from these test results, the first outlet angle θ1 is less than the second outlet angle θ2. The first outlet angle θ1 is equal to zero degrees or greater and five degrees or less, and the second outlet angle θ2 is equal to thirty degrees or more and forty-five degrees or less. This improves fan performance while reducing fan noise.

With the difference in angle being made larger between the first outlet angle θ1 and the second outlet angle θ2, the air passes through the blades 72 while being significantly inclined relative to the axis of rotation as in the diagonal flow fan (see JIS B 0132 No.1011). Accordingly, the air will be provided with less energy by the blades 72 and discharged from the ventilator fan 71 at reduced pressures.

Thus, in the case of the vehicle-mounted air conditioners (particularly in the foot or defrost modes) where a significant loss in pressure of the air passage system is expected, there is a possibility that the flow of air will be insufficient.

On the other hand, when the first inlet angle θ3 is greater than the second inlet angle θ4, the first inlet angle θ3 is equal to sixty-five degrees or greater and ninety degrees or less, and the second inlet angle θ4 is equal to fifty-five degrees or more and seventy five degrees or less, it is possible to reduce noise and improve fan performance.

With the difference in angle being made larger between the first inlet angle θ3 and the second inlet angle θ4, there is a high possibility that turbulent airflow will occur between the blades 72 on the inlet side, which causes higher noise levels at low frequencies.

Figure 10:
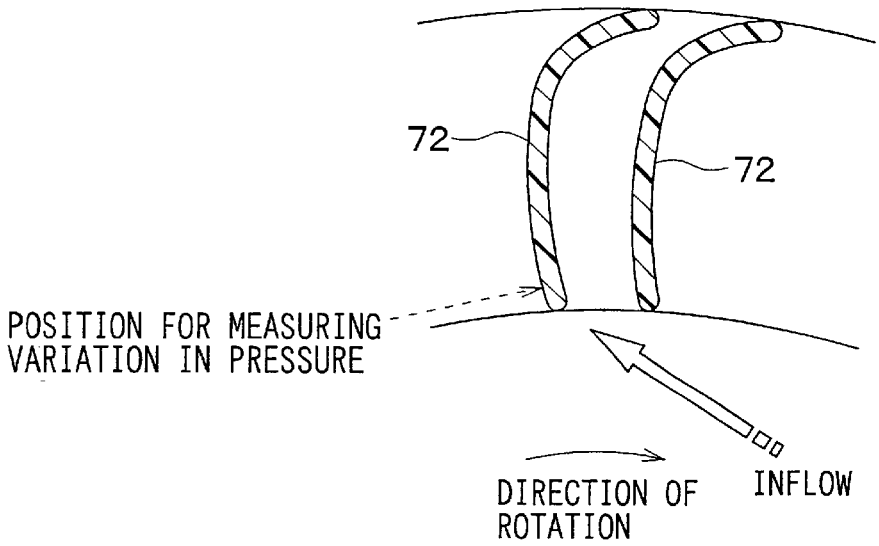
FIG. 10 is a diagram illustrating the position at which variations in pressure are measured.

The definition of the specific noise and the noise level is based on JIS B 0132, and the test methods conform to JIS B 8340. The coherence function expresses the correlation between two signals of the noise level and the variation in pressure level using zero to one. The coherence function approaches one when the correlation becomes higher. As shown in FIG. 10, the variation in pressure is measured on the surface for receiving increased pressure on the inner side of the blades 72.

Figure 11:
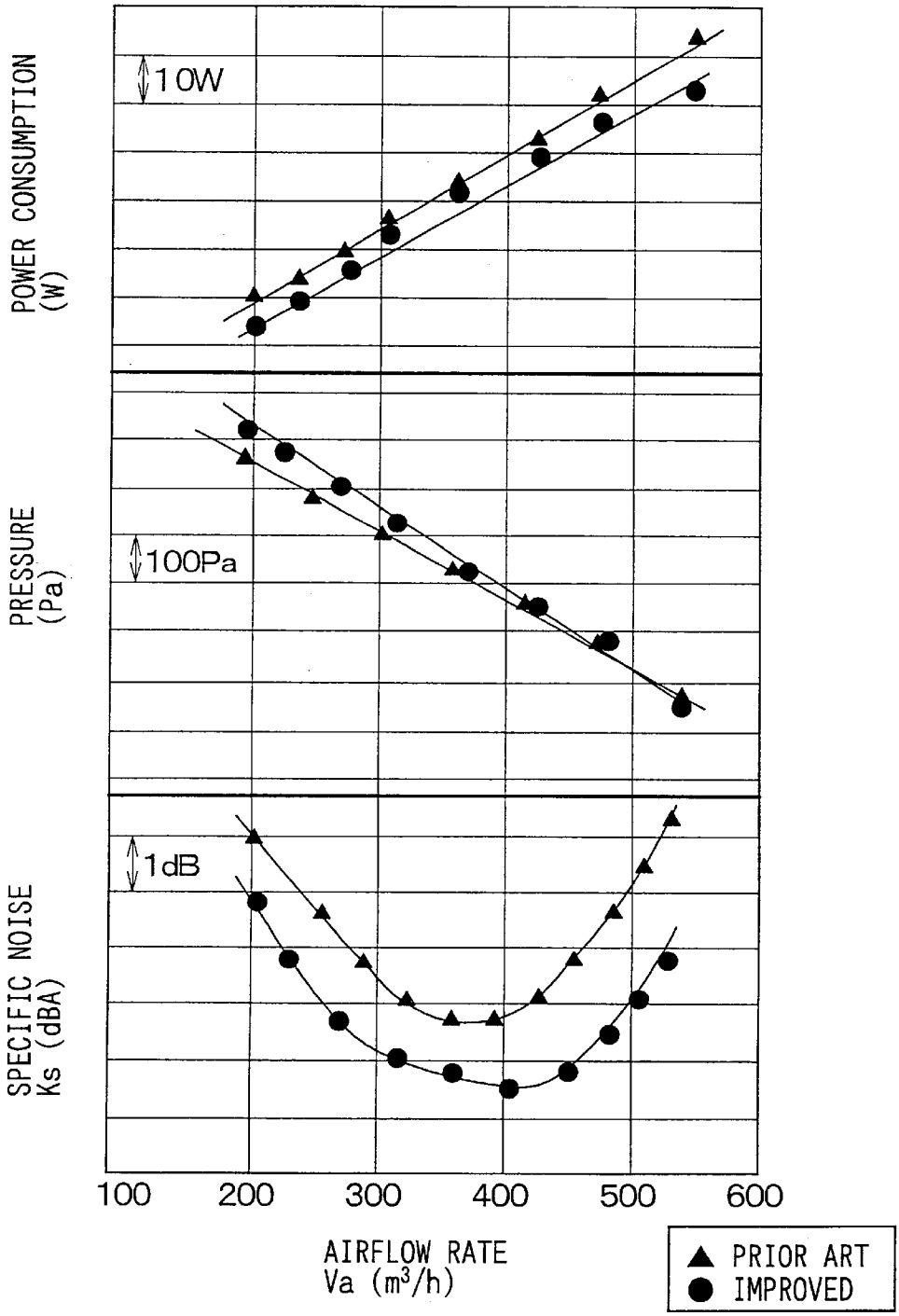
FIG. 11 is a graph showing relationships between volumetric airflow and with pressure, power consumption, and specific noise level in a ventilator fan for both the prior art and the first embodiment of the present invention.

FIG. 11 illustrates the test results of comparing a (prior art) fan, which has constant outlet and inlet angles over the entire area in the longitudinal direction of the blades, to the fan of this embodiment. As can be seen from the figure, the fan of this embodiment shows improvement in the specific noise, pressure, and power consumption levels.

In this embodiment, both the outlet and inlet angles are different from each other between the inlet end and the opposite end; however, the present invention is not so limited, and only one of the outlet or inlet angle may vary between the upstream and the downstream ends of the fan.

Additionally, the plane of the vane surface 72*a* of the blades 72 is generally parallel to the axis of rotation 70. This allows a fan mold die to easily release the fan in the direction of the axis of rotation 70, which improves the productivity of the ventilator fan manufacturing process.

Second Embodiment

In the first embodiment, the blades 72 have a constant thickness t over the entire area of the vane chord length, and the outlet and inlet angles are different from each other between the upstream and downstream ends of the fan. In this embodiment, as shown in FIGS. 12A, 12B, 13A, and 13B, the thickness t of the blades 72 increases at an edge of the vane (either at the leading edge or the trailing edge), which makes the outlet angle or the inlet angle different between the upstream and downstream ends of the fan.

Figure 12A:
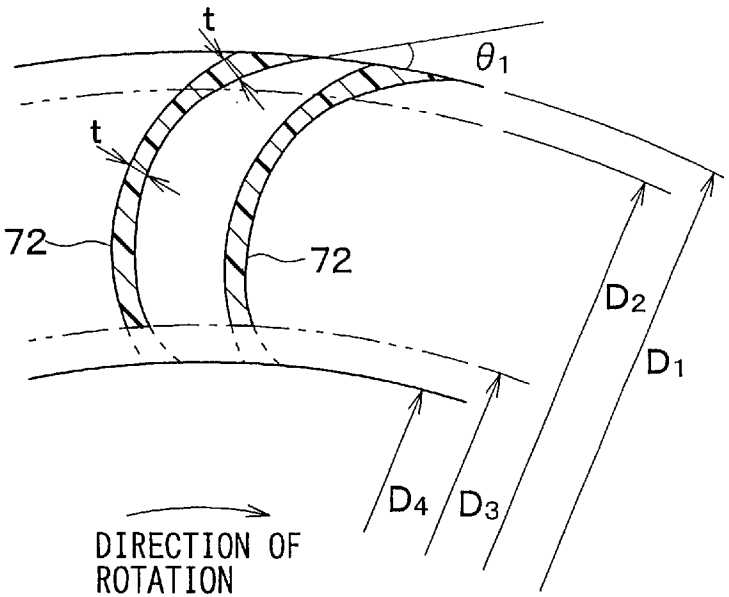
FIG. 12A is a cross-sectional view illustrating blades of a ventilator fan according to a second embodiment of the present invention taken along line A—A of FIG. 3
Figure 12B:
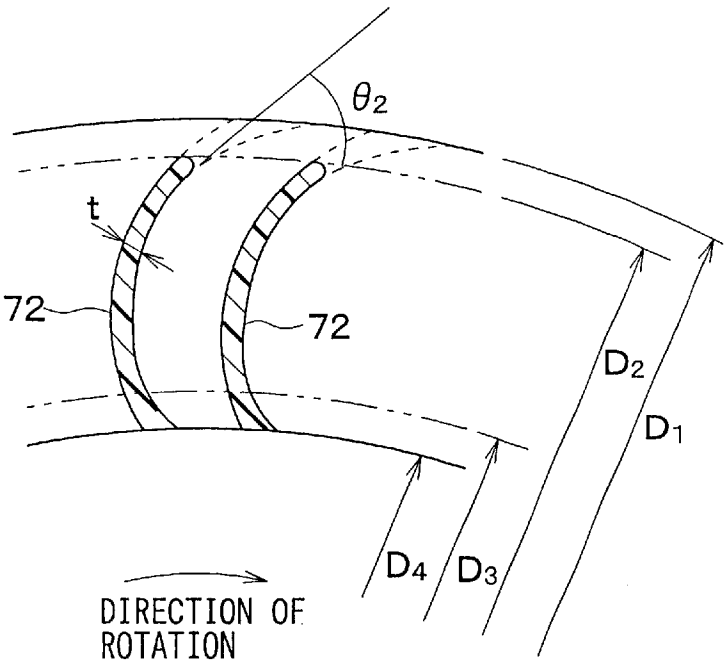
FIG. 12B is a cross-sectional view illustrating blades of a ventilator fan according to the second embodiment of the present invention taken along line B—B of FIG. 3.
Figure 13B:
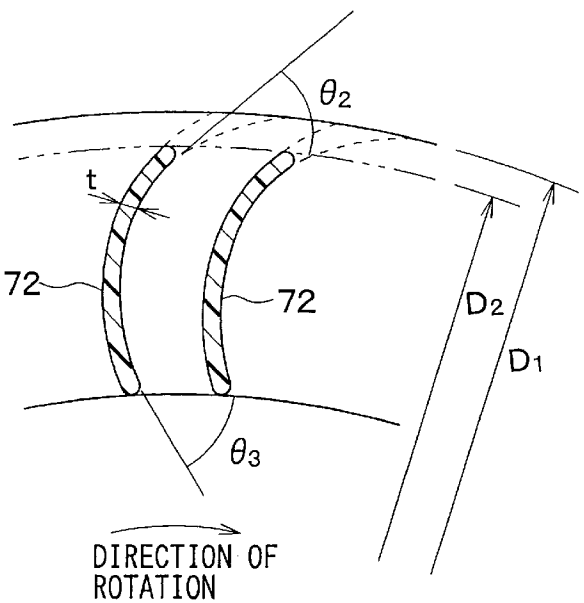
FIG. 13B is a cross-sectional view illustrating the blades of the ventilator fan according to the second embodiment of the present invention taken along line B—B of FIG. 3.
Figure 13A:
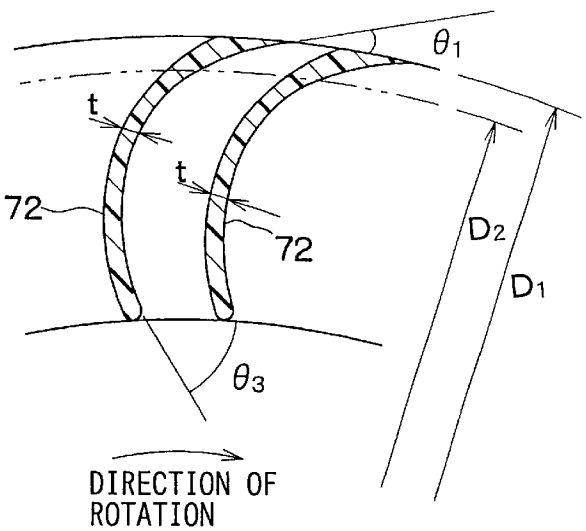
FIG. 13A is a cross-sectional view illustrating the blades of the ventilator fan according to the second embodiment of the present invention taken along line A—A of FIG. 3.

FIGS. 12A and 12B illustrate an example in which both the inlet and outlet angles differ between the upstream and downstream ends of the fan. FIGS. 13A and 13B show an example in which only the outlet angle differs between the upstream and downstream ends of the fan.

Third Embodiment

In the first embodiment, the vane chord length L is constant along the entire blade in the longitudinal direction of the blades 72. However, in the third embodiment, as shown in FIG. 14, the vane chord length L varies between the upstream end and the downstream end of the fan, which makes the outlet angle vary between the upstream end and the downstream end of the fan.

Figure 14:
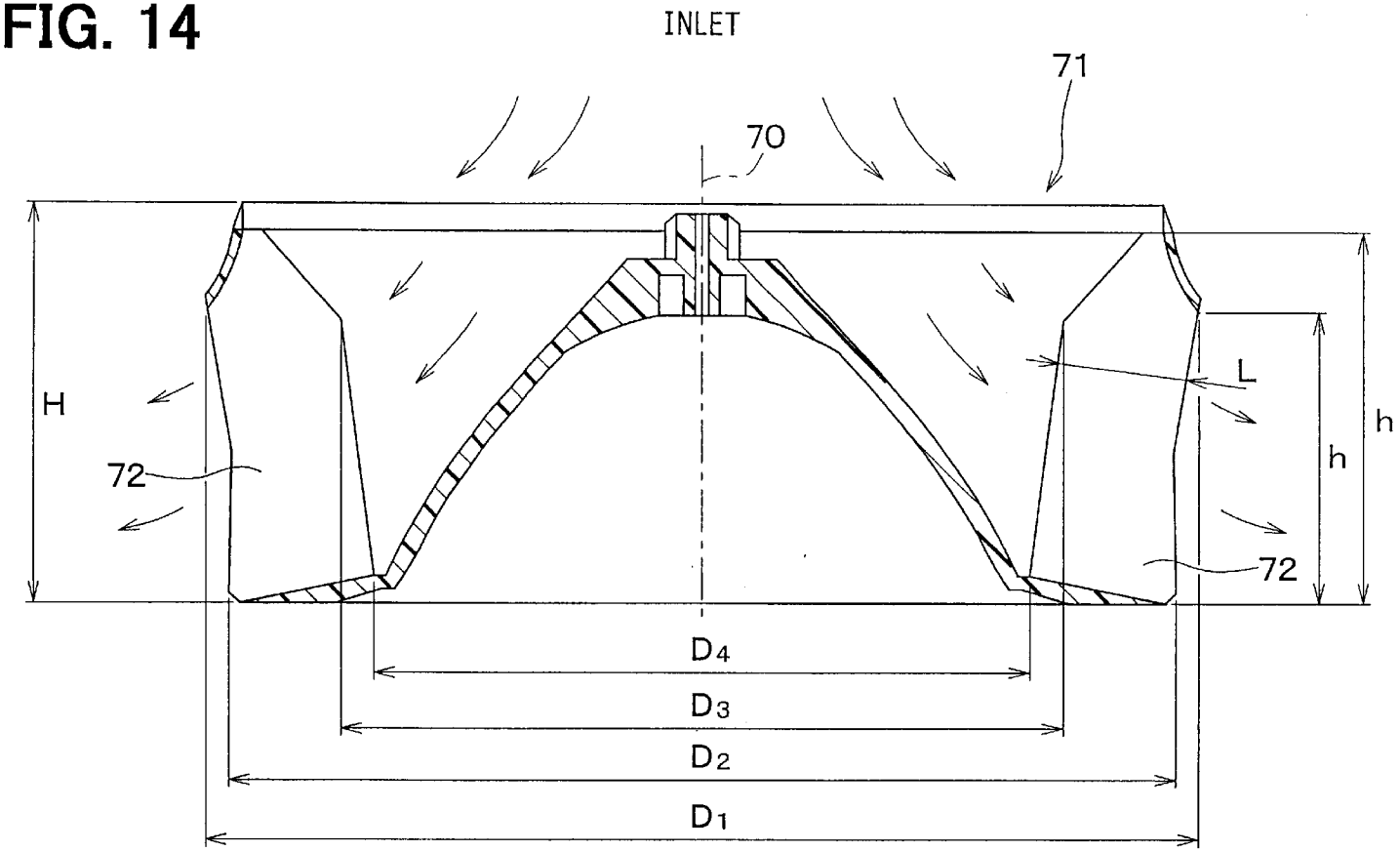
FIG. 14 is a cross-sectional view illustrating a ventilator fan rotor according to a third embodiment of the present invention.

In FIG. 14, only the outlet angle varies between the upstream end and the downstream end of the fan. However, as a matter of course, only the inlet angle or both the inlet and outlet angles may vary between the upstream end and the downstream end of the fan.

Fourth Embodiment

Figure 15:
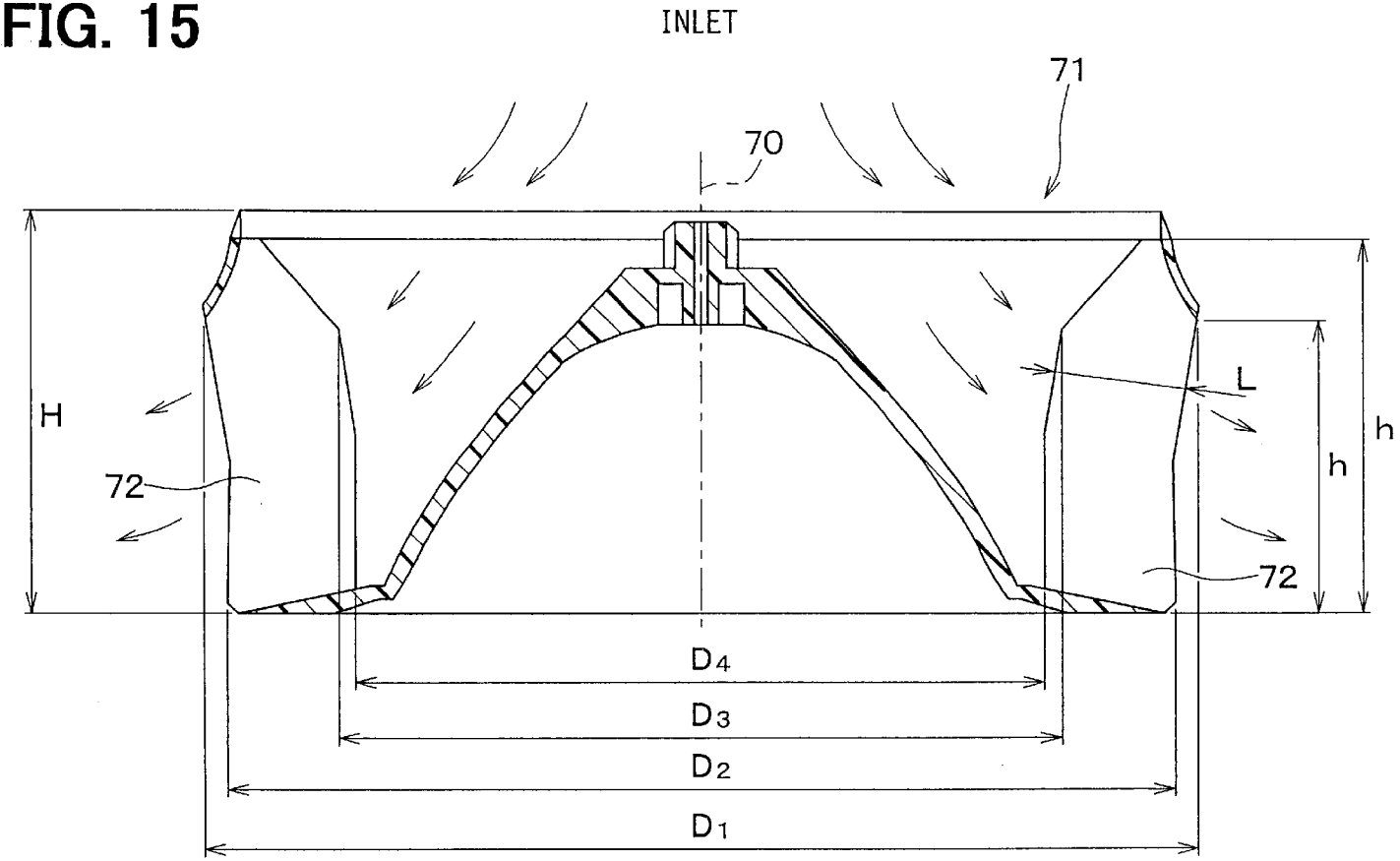
FIG. 15 is a cross-sectional view illustrating a ventilator fan rotor according to a fourth embodiment of the present invention.

In the first and second embodiments, the centerline of the blades 72 is inclined at the same angle relative to the axis of rotation 70 over the entire length of each blade. However, in this embodiment, as shown in FIG. 15, the angle between the centerline of each blade 72 and the axis of rotation may change.

Fifth Embodiment

Figure 16B:
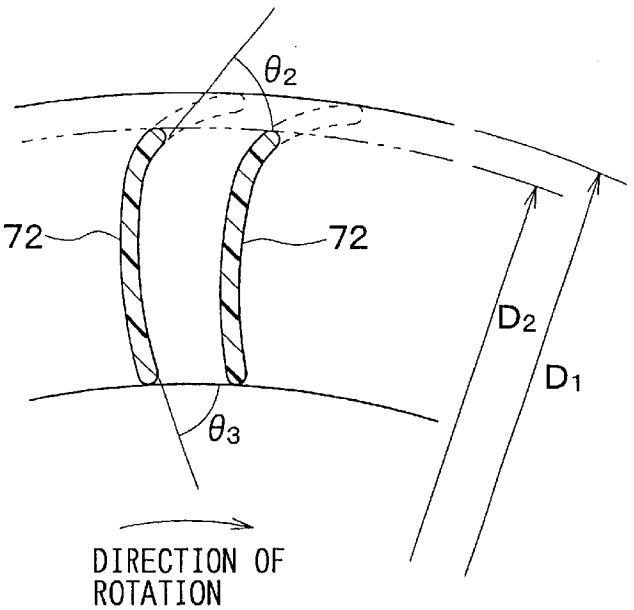
FIG. 16B is a cross-sectional view taken along line B—B of FIG. 17.
Figure 16A:
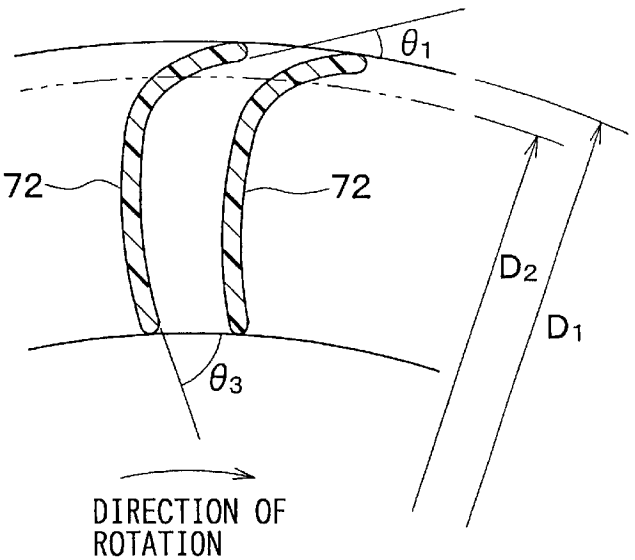
FIG. 16A is a cross-sectional view taken along line A—A of FIG. 17
Figure 17:
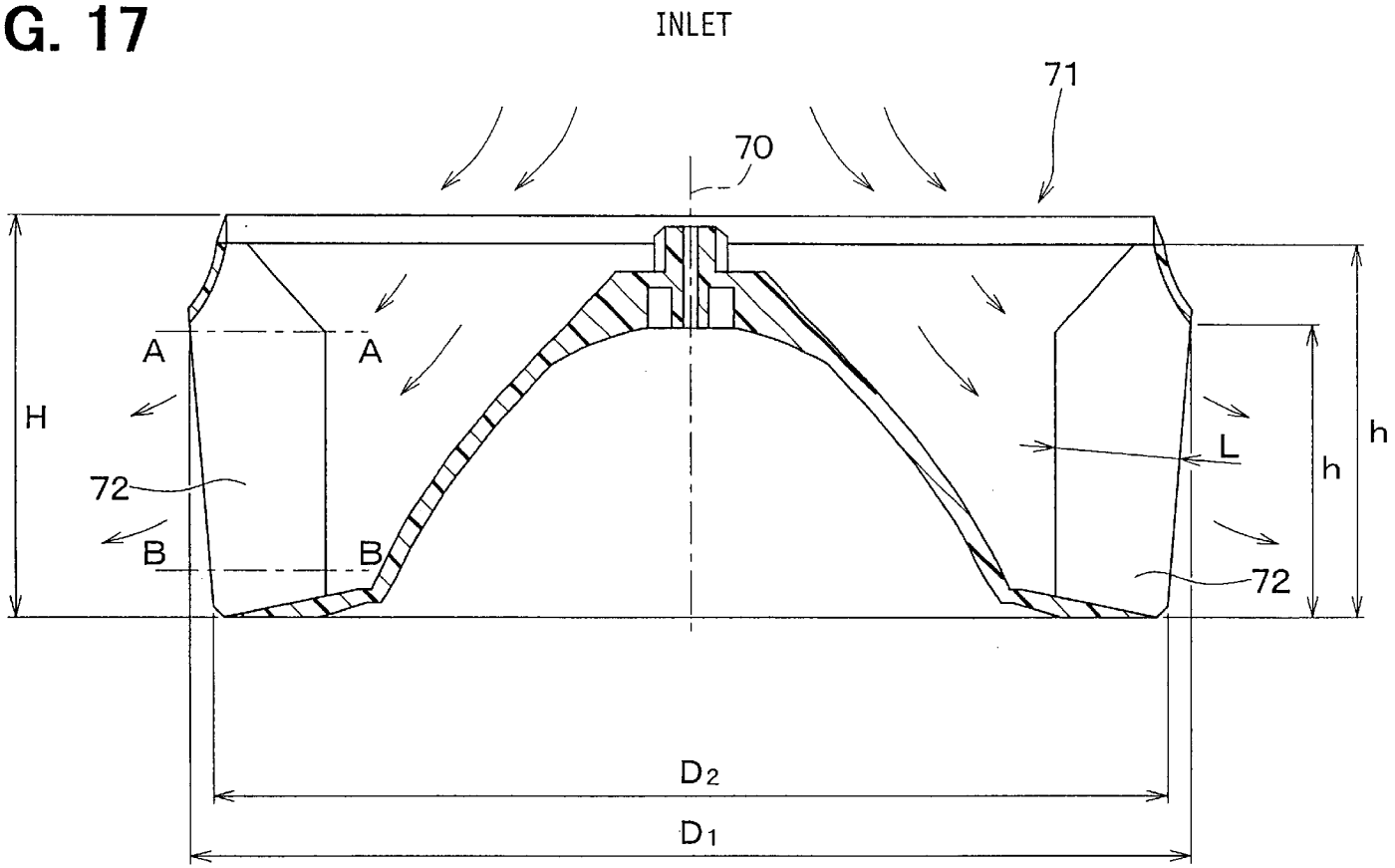
FIG. 17 is a cross-sectional view illustrating a ventilator fan according to a fifth embodiment of the present invention.

As shown in FIGS. 16A and 16B, in this embodiment, only the outlet angle varies between the upstream end and the downstream end of the fan.

Sixth Embodiment

Figure 18B:
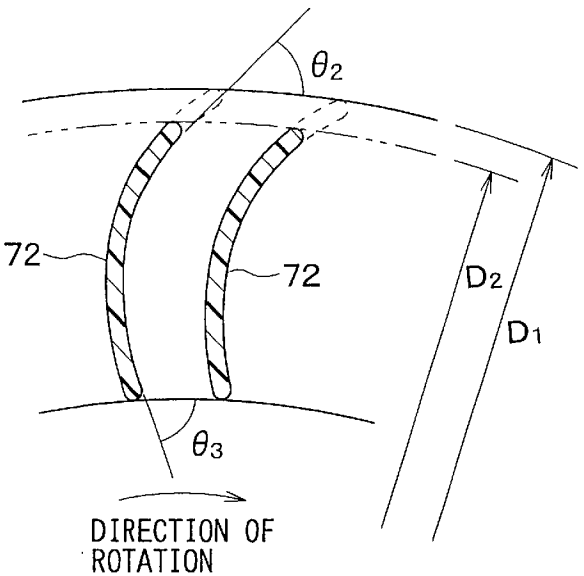
FIG. 18B is a cross-sectional view illustrating blades of a ventilator fan according to the sixth embodiment of the present invention taken along line B—B of FIG. 3.
Figure 18A:
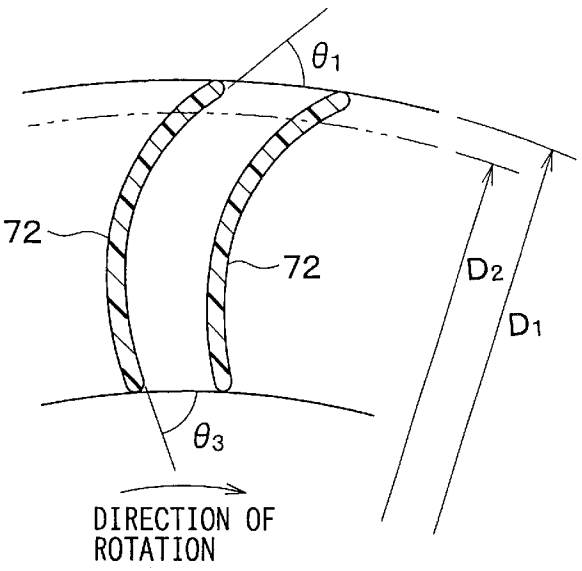
FIG. 18A is a cross-sectional view illustrating blades of a ventilator fan according to a sixth embodiment of the present invention taken along line A—A of FIG. 3

In the first embodiment, the blades 72 are designed to have a curved surface with multiple radiuses of curvature. However, in the embodiment of FIGS. 18A and 18B, the blades 72 are configured to have a curved surface with a constant radius of curvature.

Other Embodiments

In the illustrated embodiments, the invention is applied to a vehicle-mounted air conditioner; however, the present invention is not so limited and is applicable to other devices.

What is claimed is:

1. A centrifugal ventilator fan, having multiple blades spaced about an axis of rotation, wherein air enters axially through an upstream end of the fan and is discharged radially from the fan, wherein an outlet angle of each blade is generally defined by a line extending outward from the outer end of a leading surface of each blade and a circle defined by the outer edges of the blades, and wherein a first fan outlet angle of each blade, which is measured at an upstream end of the fan, is less than a second fan outlet angle of the blades, which is measured at a downstream end of the fan, and wherein the first outlet angle of each blade is equal to zero degrees or greater and five degrees or less, and the second outlet angle is equal to thirty degrees or greater and forty-five degrees or less.

2. A centrifugal ventilator fan, having multiple blades spaced about an axis of rotation, wherein air enters axially through an upstream end of the fan and is discharged radially from the fan, wherein an inlet angle of each blade is generally defined by a line extending inward from the inner end of a leading surface of each blade and a circle defined by the inner edges of the blades, and wherein a first fan inlet angle of each blade, which is measured at an upstream end of the fan, is greater than a second fan inlet angle of the blades, which is measured at a downstream end of the fan, and wherein the first inlet angle of each blade is equal to sixty-five degrees or greater and ninety degrees or less, and the second inlet angle is equal to fifty-five degrees or greater and seventy-five degrees or less.

3. A centrifugal ventilator fan, having multiple blades spaced about an axis of rotation, wherein air enters axially through an upstream end of the fan and is discharged radially from the fan, wherein an outlet angle of each blade is generally defined by a line extending outward from the outer end of a leading surface of each blade and a circle defined by the outer edges of the blades, and wherein a first fan outlet angle of each blade, which is measured at an upstream end of the fan, is less than a second fan outlet angle of the blades, which is measured at a downstream end of the fan, and wherein the first outlet angle of each blade is equal to zero degrees or greater and five degrees or less, and the second outlet angle is equal to thirty degrees or greater and forty-five degrees or less, and wherein an inlet angle of each blade is generally defined by a line extending inward from the inner end of a leading surface of each blade and a circle defined by the inner edges of the blades, and wherein a first fan inlet angle of each blade, which is measured at an upstream end of the fan, is greater than a second fan inlet angle of the blades, which is measured at a downstream end of the fan, and wherein the first inlet angle of each blade is equal to sixty-five degrees or greater and ninety degrees or less, and the second inlet angle is equal to fifty-five degrees or greater and seventy-five degrees or less.

4. The centrifugal ventilator fan according to claim 3, wherein a plane of a vane surface of each blade is generally parallel to the axis of rotation.

5. The centrifugal ventilator fan according to claim 4, wherein the ratio of the fan inner diameter at the downstream end of the fan to the fan inner diameter at the upstream end of the fan is equal to 0.9 or greater and 1.0 or less.

6. The centrifugal ventilator fan according to claim 4, wherein the ratio of the fan outer diameter at the downstream end of the fan to the fan outer diameter at the upstream end of the fan is 0.9 or greater and 1.0 or less.

7. The centrifugal ventilator fan according to claim 6, wherein the ratio of the fan inner diameter at the downstream end of the fan to the fan inner diameter at the upstream end of the fan is equal to 0.9 or greater and 1.0 or less.

8. The centrifugal ventilator fan according to claim 3, wherein the ratio of the fan inner diameter at the downstream end of the fan to the fan inner diameter at the upstream end of the fan is equal to 0.9 or greater and 1.0 or less.

9. The centrifugal ventilator fan according to claim 3, wherein the ratio of the fan outer diameter at the downstream end of the fan to the fan outer diameter at the upstream end of the fan is 0.9 or greater and 1.0 or less.

10. The centrifugal ventilator fan according to claim 9, wherein the ratio of the fan inner diameter at the downstream end of the fan to the fan inner diameter at the upstream end of the fan is equal to 0.9 or greater and 1.0 or less.

11. A centrifugal fan, comprising a plurality of blades arranged in a cylindrical fashion about an axis, wherein each blade has an upstream end located at an upstream end of the fan, which is close to an inlet of the fan, and a downstream end, which is opposite to the upstream end, and the blades have surfaces that are generally parallel to the rotational axis, and wherein the blades define an outer diameter, which increases in the axial direction toward the upstream end of the fan, and each of the blades has an outlet angle, which is defined by a line extending from a leading surface at an outer edge of each blade and a circle defined by the outer edges of the blades, and the outlet angle of the upstream end of each blade is less than that of the downstream end of the same blade.

12. A centrifugal fan, comprising a plurality of blades arranged in a cylindrical fashion about an axis, wherein each blade has an upstream end located at an upstream end of the fan, which is close to an inlet of the fan, and a downstream end, which is opposite to the upstream end, and the blades have surfaces that are generally parallel to the rotational axis, and wherein the blades define an inner diameter, which increases in the axial direction toward the upstream end of the fan, and each of the blades has an inlet angle, which is defined by a line extending from a leading surface at an inner edge of each blade and a circle defined by the inner edges of the blades, and the inlet angle of the upstream end of each blade is greater than that of the downstream end of the same blade.

* * * * *